US007922253B2

(12) United States Patent
Chen

(10) Patent No.: US 7,922,253 B2
(45) Date of Patent: Apr. 12, 2011

(54) SOFA KIT

(76) Inventor: Lionel T. Chen, Rowland Heights, CA (US)

( * ) Notice: Subject to any disclaimer, the term of this patent is extended or adjusted under 35 U.S.C. 154(b) by 76 days.

(21) Appl. No.: 12/460,021

(22) Filed: Jul. 9, 2009

(65) Prior Publication Data

US 2010/0244537 A1 Sep. 30, 2010

Related U.S. Application Data

(63) Continuation-in-part of application No. 12/383,905, filed on Mar. 30, 2009.

(51) Int. Cl.
*A47C 7/00* (2006.01)

(52) U.S. Cl. ..... 297/440.1; 297/440.14; 297/440.15; 297/440.16

(58) Field of Classification Search ..... 297/440.1, 297/440.12, 440.14–440.16, 463.1
See application file for complete search history.

(56) References Cited

U.S. PATENT DOCUMENTS 2,466,204 A * 4/1949 Brown ..... 297/115
2,660,228 A * 11/1953 Reinhold ..... 297/440.1
2,703,136 A * 3/1955 Masse ..... 297/119
2,732,889 A * 1/1956 Healy ..... 297/411.28
2,829,707 A * 4/1958 Liebson ..... 297/411.42
3,001,822 A * 9/1961 Pagliaro et al. ..... 297/381
3,030,146 A * 4/1962 Faxon ..... 297/411.45
3,066,982 A * 12/1962 Brower ..... 297/440.15
3,104,913 A * 9/1963 Faulkner et al. ..... 297/218.3
3,183,036 A * 5/1965 Hill ..... 297/440.22
3,608,959 A * 9/1971 Sarvas ..... 297/218.3
4,035,020 A * 7/1977 Gold ..... 297/271.5
4,074,919 A * 2/1978 Watts ..... 297/233
4,077,517 A * 3/1978 Hilemn ..... 206/577
5,601,340 A * 2/1997 Stout ..... 297/440.16
5,678,897 A * 10/1997 Prestia ..... 297/440.15
5,890,767 A * 4/1999 Chang ..... 297/440.14
6,070,941 A * 6/2000 Chung ..... 297/440.16
6,296,314 B1 * 10/2001 Klein ..... 297/440.14
6,568,058 B1 * 5/2003 Wieland et al. ..... 29/91.1
6,669,401 B1 * 12/2003 Lin ..... 403/408.1
6,695,408 B1 * 2/2004 Nobbe ..... 297/440.11
6,942,298 B2 * 9/2005 Harrison ..... 297/440.1
7,300,111 B2 * 11/2007 Huang ..... 297/440.16
7,387,344 B2 * 6/2008 Yu ..... 297/440.1
(Continued)

*Primary Examiner* — Laurie K Cranmer
(74) *Attorney, Agent, or Firm* — Charles R. Sutton; Law Offices of Roger C. Hsu

(57) ABSTRACT

This invention concerns a sofa which solves the problems of the prior art by providing a sofa that can easily be assembled or disassembled by the end consumer at home. The disassembled sofa can be stored in 3 flat boxes. Storage in the flat boxes not only helps the warehouse to store the sofa, but when the end user has purchased the sofa it is easier in such flat boxes to transport it to the location where it will be assembled. The way this invention accomplishes these results is as follows: The parts of the sofa can be broken down into three boxes. Chaise sections can be assembled by placing the seat back flat on the ground and placing the seat frame/arm upright on top of the seat back. A metal threaded rod is used to connect the seat frame and the seat back. A metal nut is used to secure the seat frame to the back using a wrench that comes provided in the package of the kit. The legs are then twisted onto the bottom of the seat frame. The Chaise can be assembled in a left handed or right handed configuration. There is also a love seat portion and an ottoman portion. The love seat portion can also be assembled in a left handed or right handed configuration.

2 Claims, 13 Drawing Sheets

U.S. PATENT DOCUMENTS 7,419,220 B2 * 9/2008 White et al. ..... 297/440.14
7,547,073 B2 * 6/2009 White et al. ..... 297/440.1
7,744,162 B2 * 6/2010 Griggs, Jr. ..... 297/440.14
2007/0007813 A1 * 1/2007 Pomeroy et al. ..... 297/440.1

* cited by examiner

SOFA KIT

CROSS REFERENCE TO RELATED APPLICATIONS

This application is a continuation-in-part application which is a continuation of U.S. patent application Ser. No. 12/383,905 filed on Mar. 30, 2009 by Lionel T. Chen.

STATEMENT REGARDING FEDERALLY SPONSORED RESEARCH AND DEVELOPMENT

This invention was not made using federally sponsored research and development.

THE NAMES OF THE PARTIES TO A JOINT RESEARCH AGREEMENT

None.

REFERENCE TO A SEQUENCE LISTING

There is no sequence listing in this application.

BACKGROUND OF THE INVENTION

This invention relates to the field of furniture and more particularly to the packaging of sofa kits. Sofas have long been known in the furniture making arts but the traditional sofa design with a one piece frame is not susceptible to easy assembly and disassembly. It is also not easy to package such a sofa in a flat box for storage at the seller's warehouse.

BRIEF SUMMARY OF THE INVENTION

This invention concerns a sofa which solves the problems of the prior art by providing a sofa that can easily be assembled or disassembled by the end consumer at home.

The disassembled sofa can be stored in a flat box. Storage in the flat box not only helps the warehouse to store the sofa, but when the end user has purchased the sofa it is easier in such a flat box to transport it to the location where it will be assembled. The way this invention accomplishes these results is as follows: The parts of the sofa can be broken down into three boxes. Chaise sections can be assembled by placing the seat back flat on the ground and placing the seat frame/arm upright on top of the seat back. A metal threaded rod is used to connect the seat frame and the seat back. A metal nut is used to secure the seat frame to the back using a wrench that comes provided in the package of the kit. The legs are then twisted onto the bottom of the seat frame. The Chaise can be assembled in a left handed or right handed configuration. There is also a love seat portion and an ottoman portion. The love seat portion can also be assembled in a left handed or right handed configuration.

DETAILED DESCRIPTION OF THE INVENTION

Figure 1:
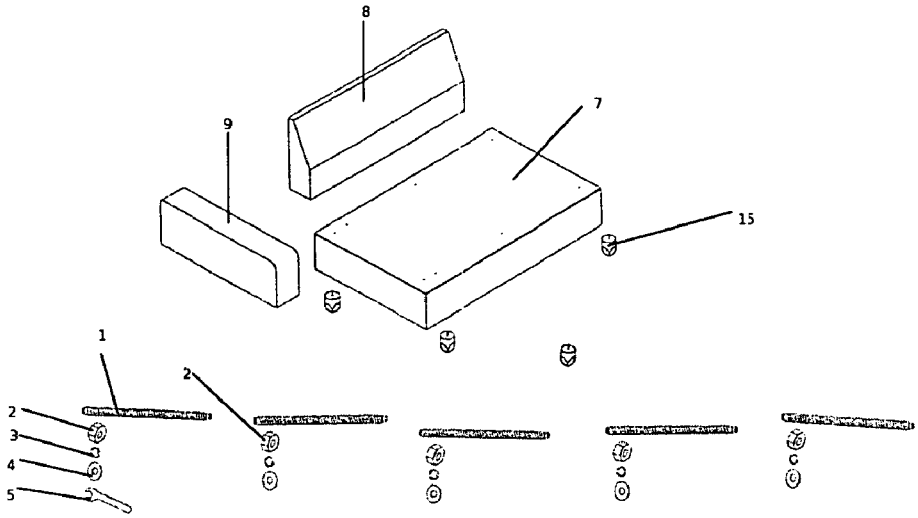
FIG. 1 is a fully exploded diagram of the first portion of the kit.
Figure 2:
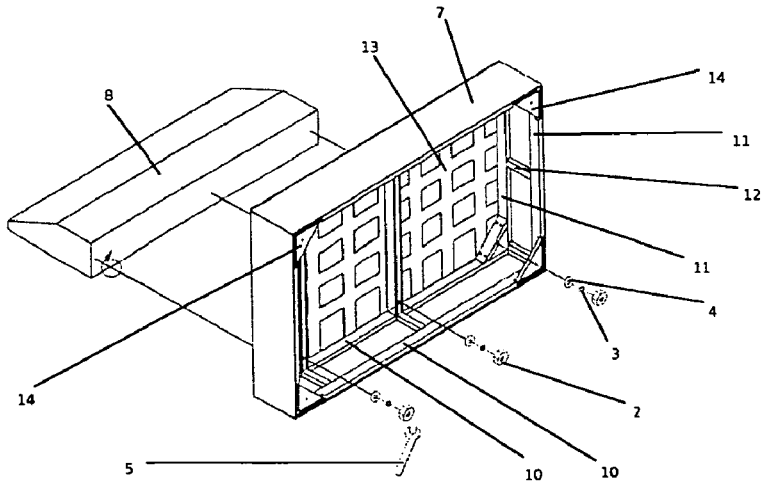
FIG. 2 shows the first step in the assembly of the first portion.
Figure 3:
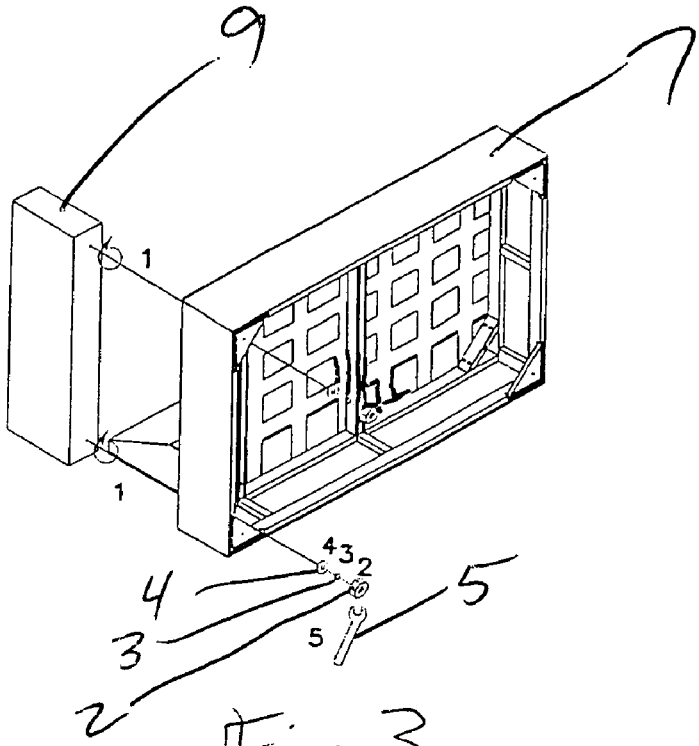
FIG. 3 shows the second step in the assembly of the first portion (right handed).
Figure 4:
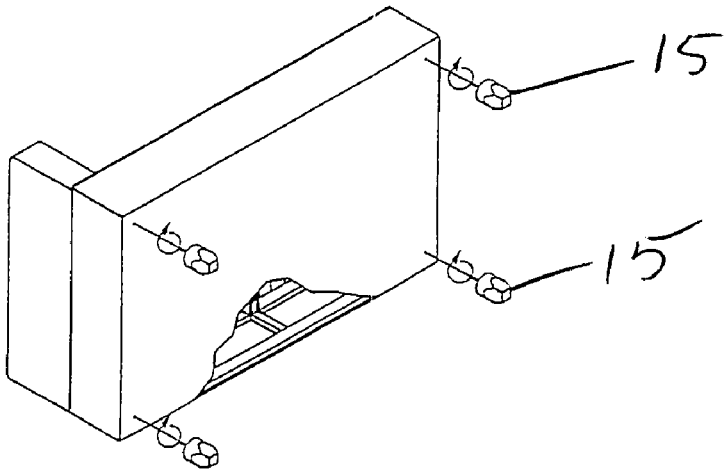
FIG. 4 shows the third step in the assembly of the first portion (right handed).
Figure 5:
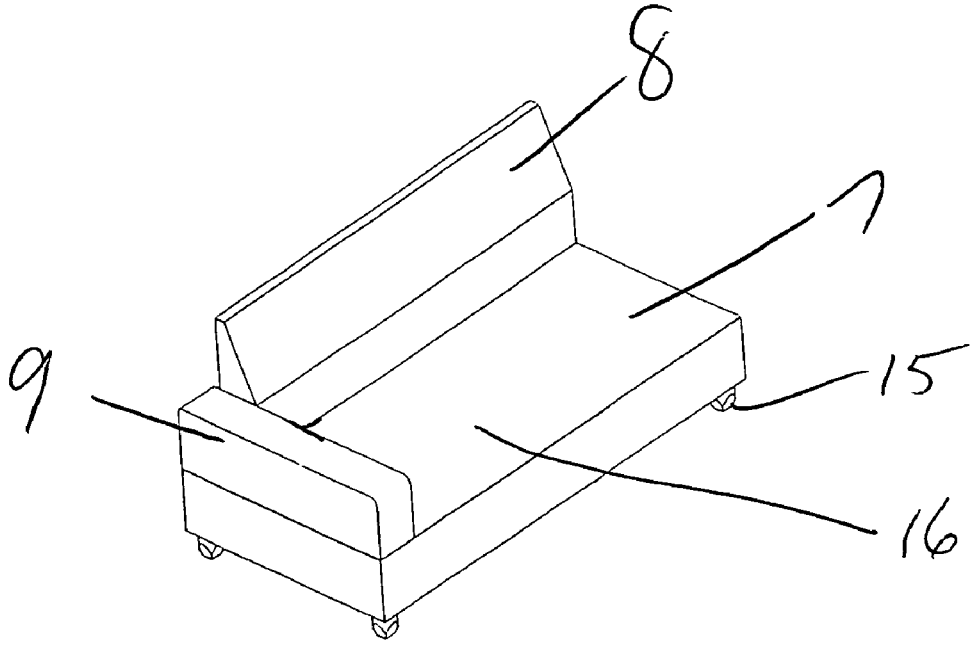
FIG. 5 shows the fourth step in the assembly of the first portion (right handed).
Figure 6:
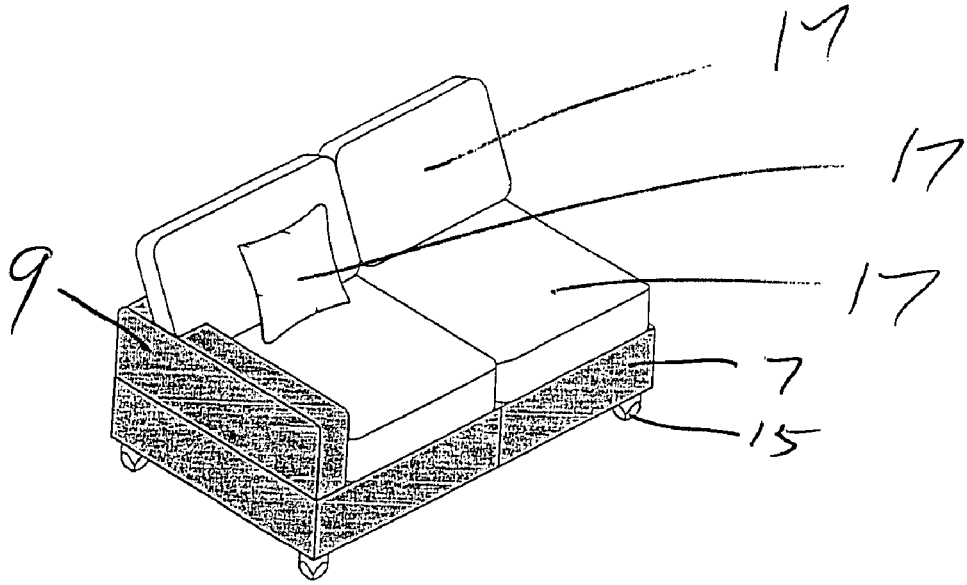
FIG. 6 shows the final step in the assembly of the first portion (right handed).
Figure 7:
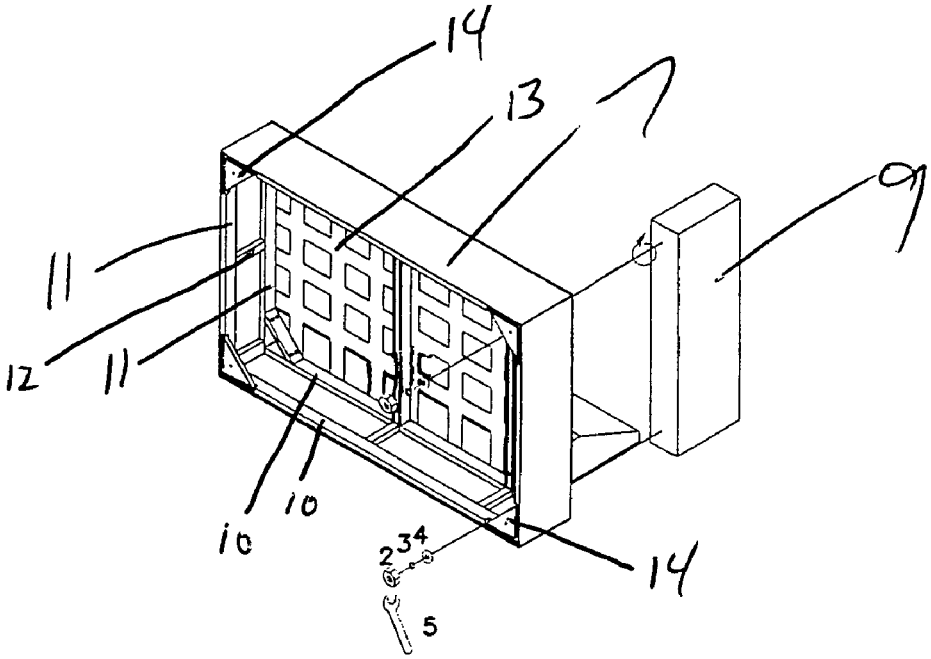
FIG. 7 shows the second step in the assembly of the first portion (left handed).
Figure 8:
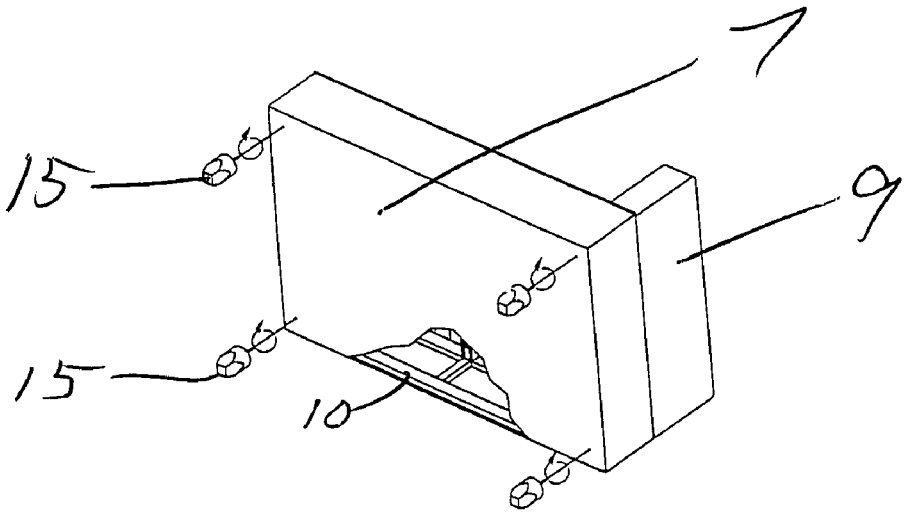
FIG. 8 shows the third step in the assembly of the first portion (left handed).
Figure 9:
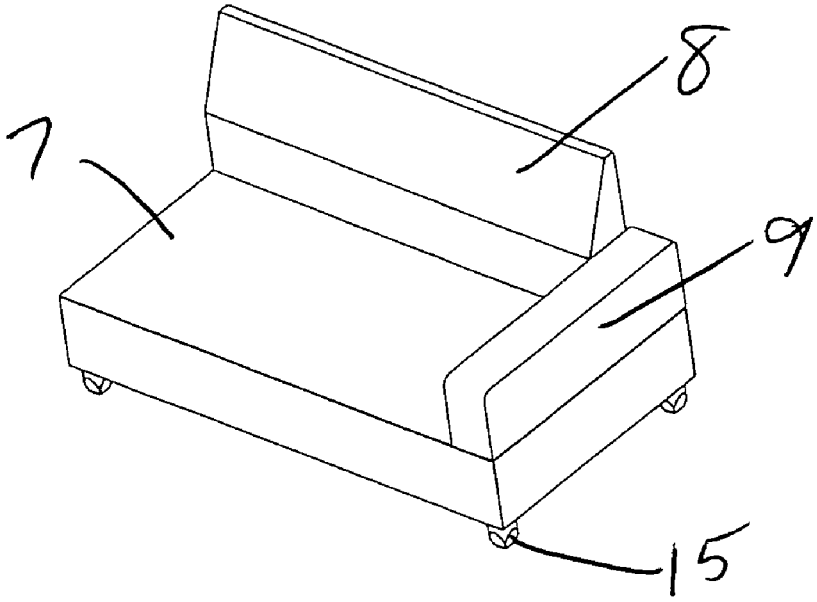
FIG. 9 shows the fourth step in the assembly of the first portion (left handed).
Figure 10:
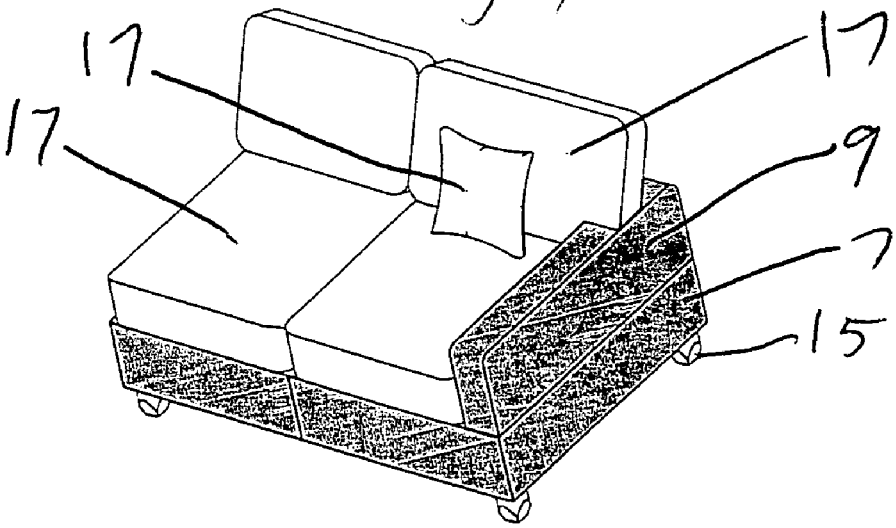
FIG. 10 shows the final step in the assembly of the first portion (left handed).
Figure 11:
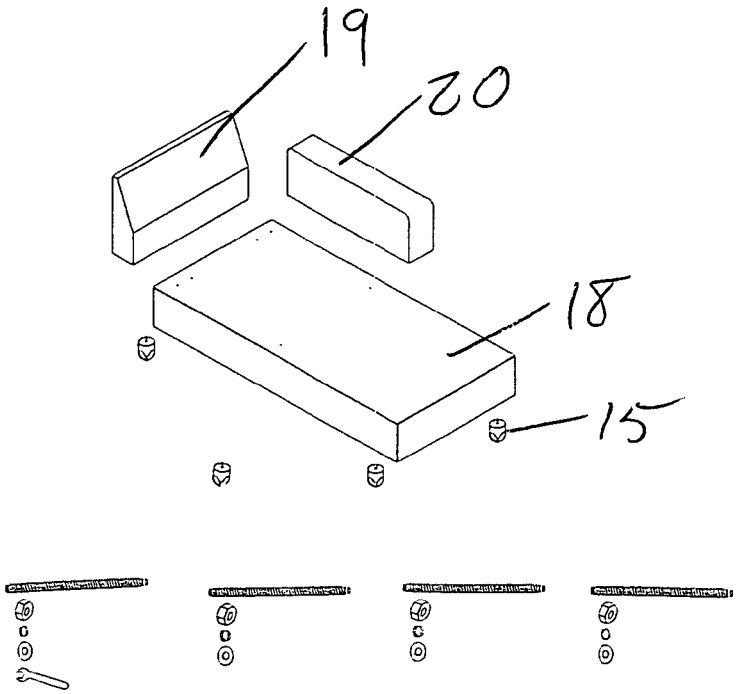
FIG. 11 shows a fully exploded diagram of the parts of the second portion of the sofa kit.
Figure 12:
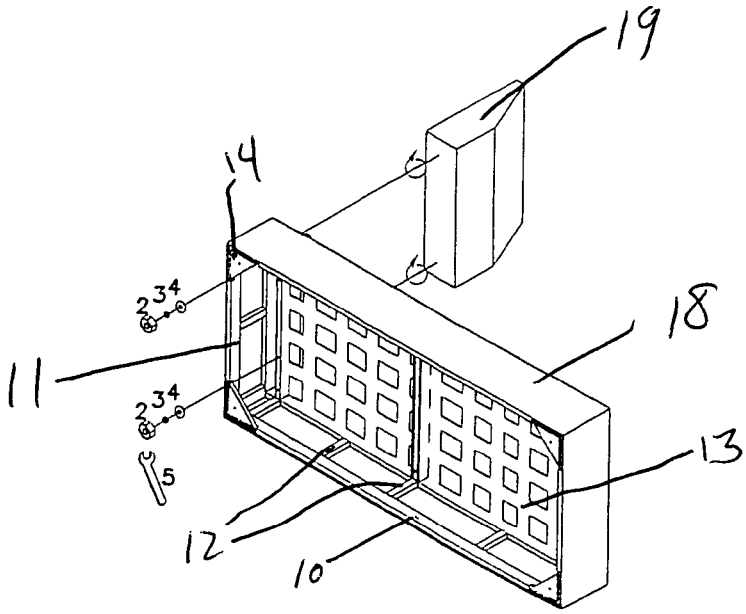
FIG. 12 shows the first assembly step of the second portion (right handed).
Figure 13:
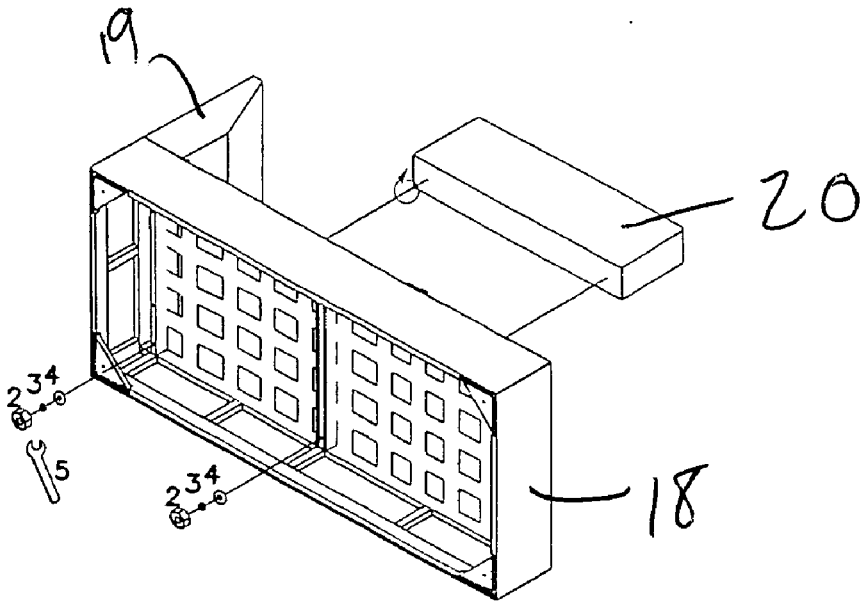
FIG. 13 shows the second assembly step of the second portion (right handed).
Figure 14:
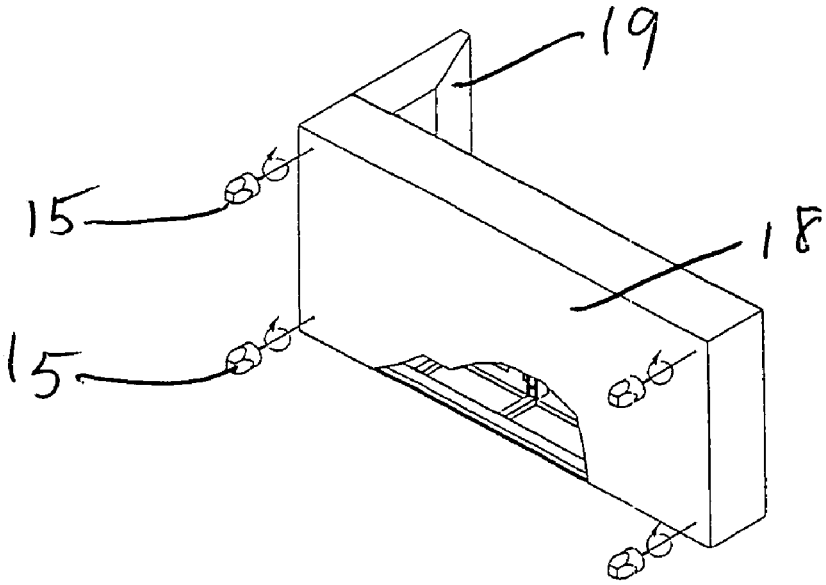
FIG. 14 shows the third assembly step of the second portion (right handed).
Figure 15:
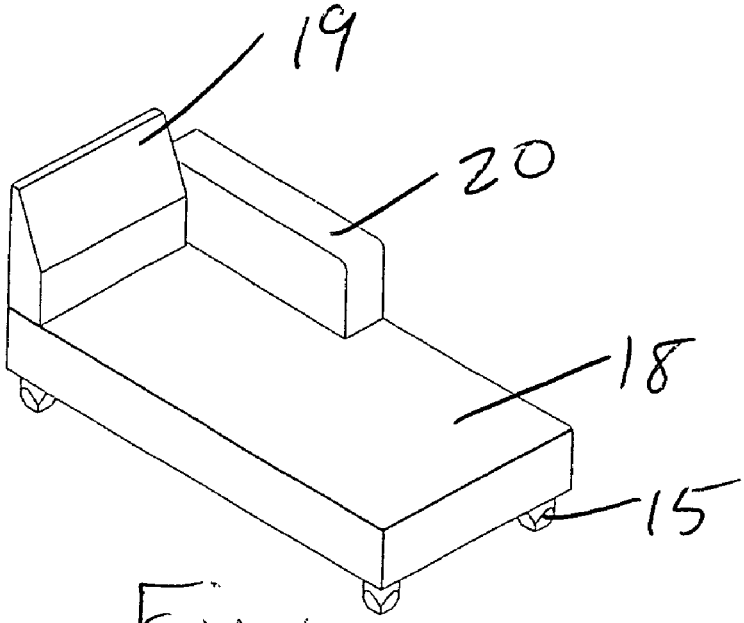
FIG. 15 shows the fourth assembly step of the second portion (right handed).
Figure 16:
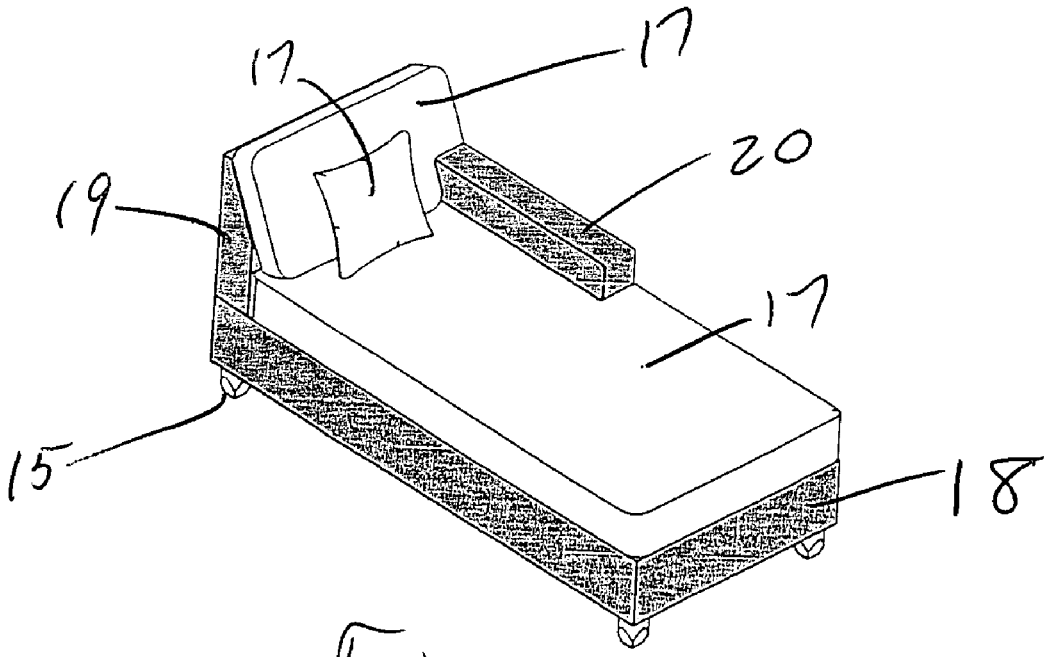
FIG. 16 shows the fifth assembly step of the second portion (right handed).
Figure 17:
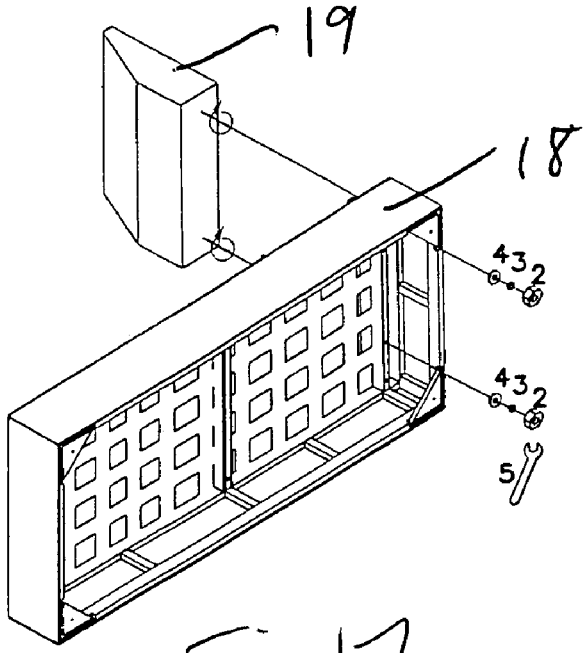
FIG. 17 shows the first assembly step of the second portion (left handed).
Figure 18:
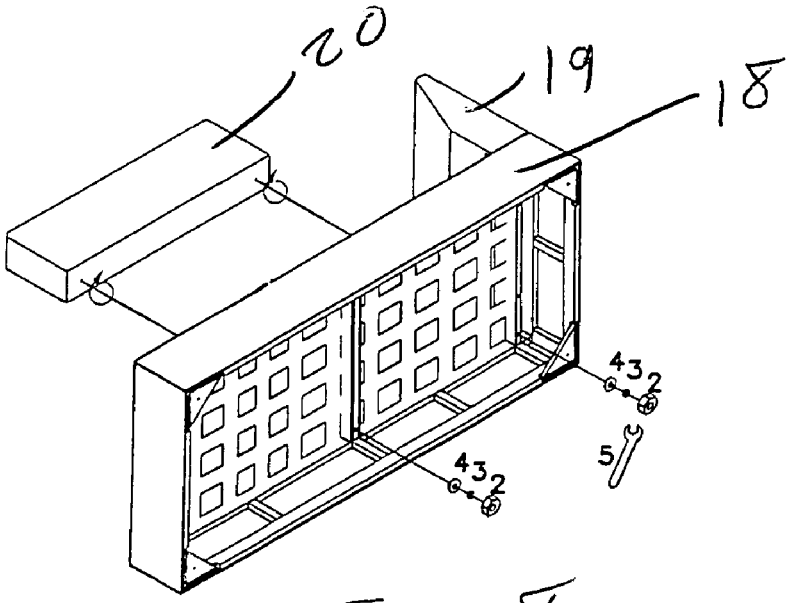
FIG. 18 shows the second assembly step of the second portion (left handed).
Figure 19:
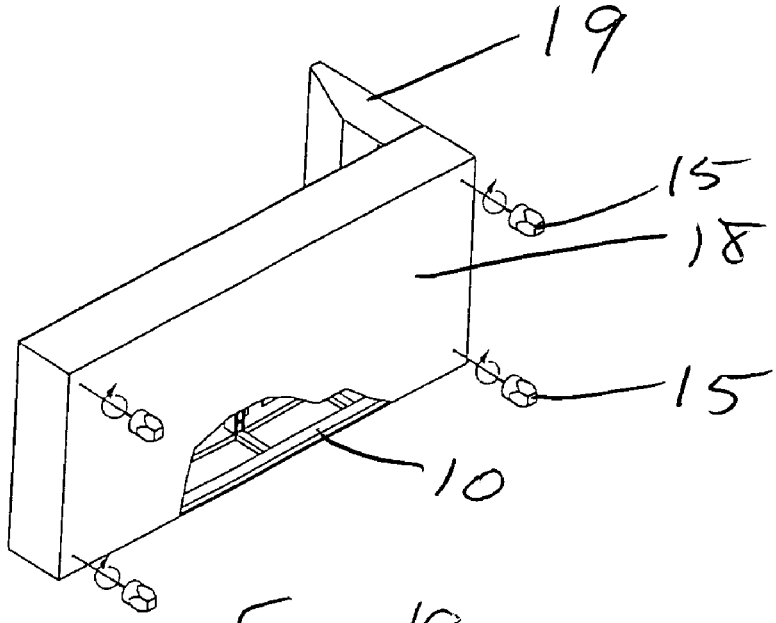
FIG. 19 shows the third assembly step of the second portion (left handed).
Figure 20:
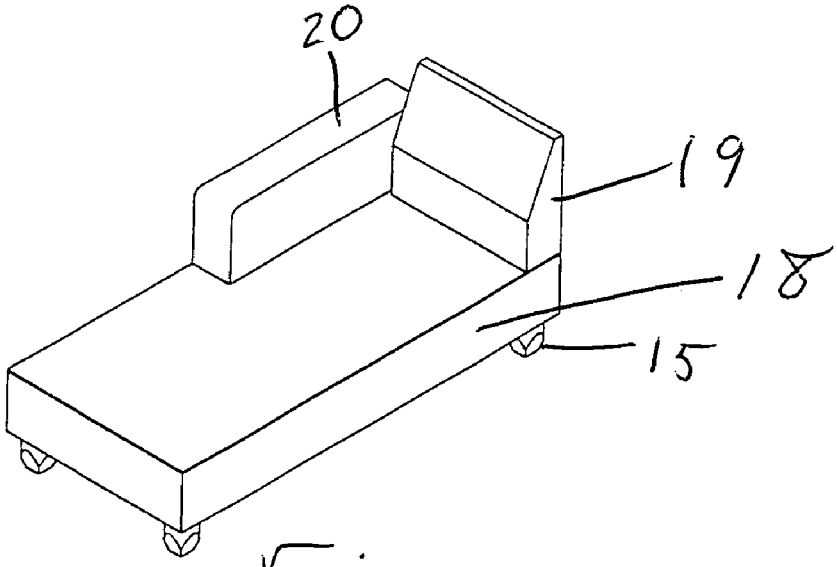
FIG. 20 shows the fourth assembly step of the second portion (left handed).
Figure 21:
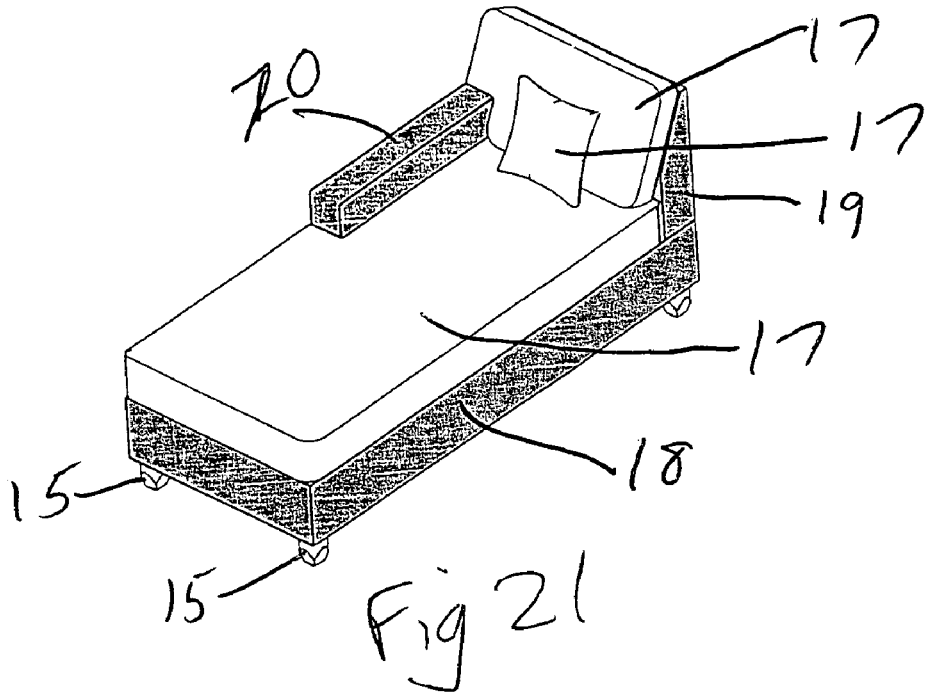
FIG. 21 shows the fifth assembly step of the second portion (left handed).
Figure 22:
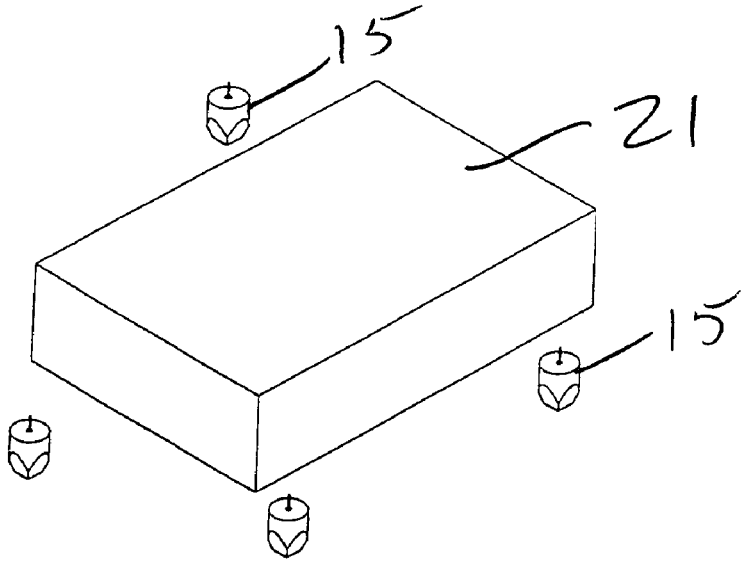
FIG. 22 shows a fully exploded diagram of the third portion of the sofa kit.
Figure 23:
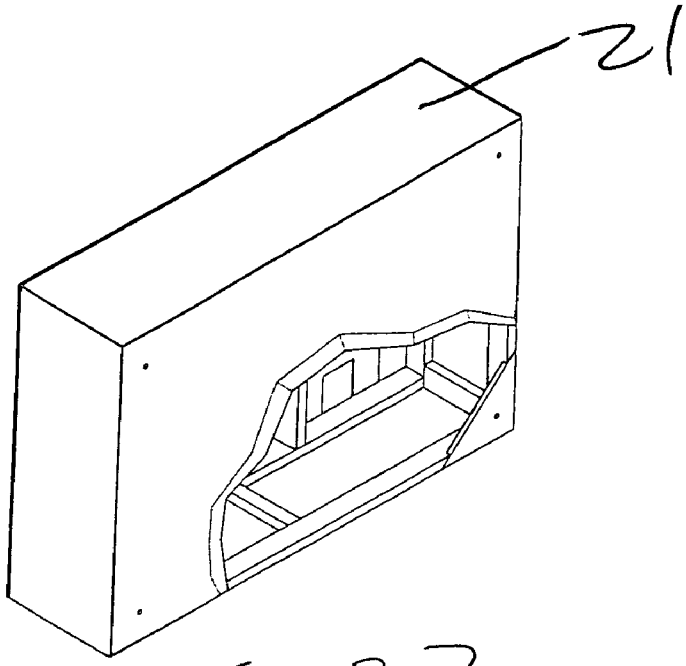
FIG. 23 shows a cutaway view of the interior of the ottoman.
Figure 24:
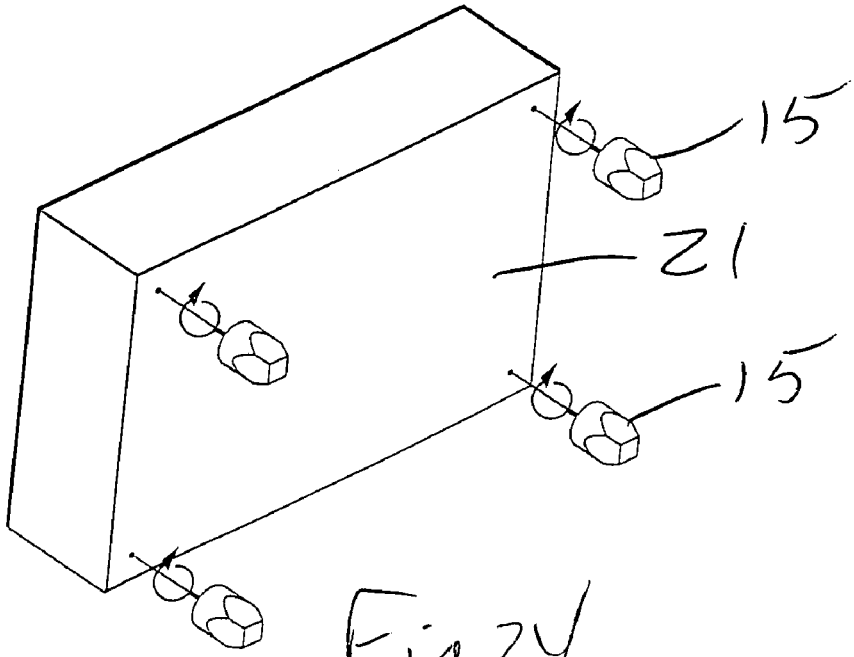
FIG. 24 shows the first step of the assembly of the third portion.
Figure 25:
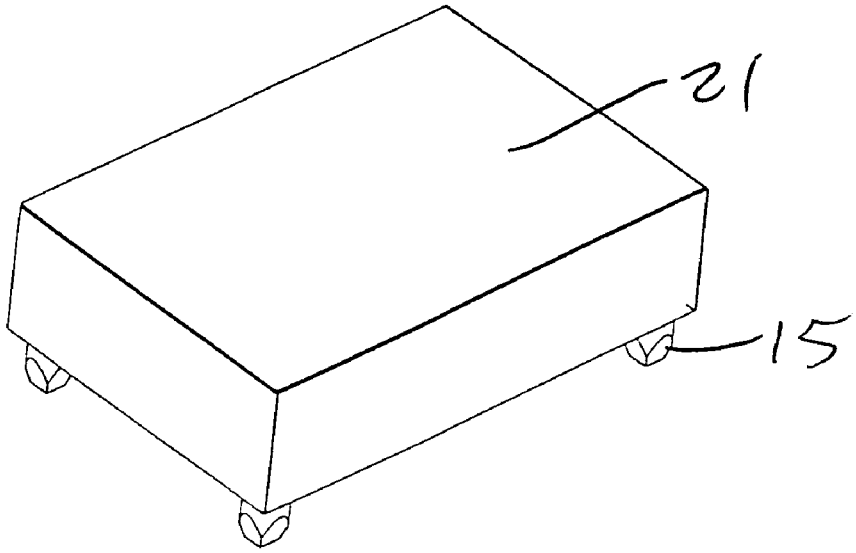
FIG. 25 shows the third portion with the legs attached.
Figure 26:
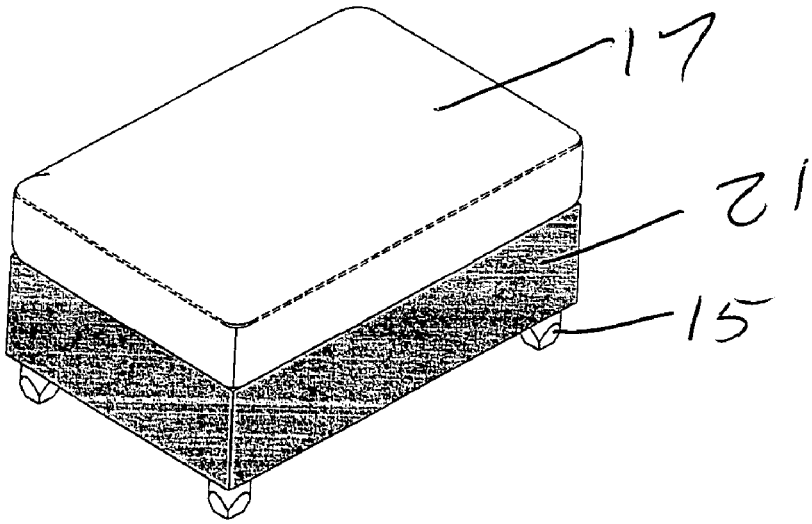
FIG. 26 shows the final step of assembling the third portion.

This invention concerns a sofa kit which solves the problems of the prior art by providing a sofa that can easily be assembled or disassembled by the end consumer at home. The disassembled sofa can be stored in three flat boxes. Storage in the flat boxes not only helps the warehouse to store the sofa, but when the end user has purchased the sofa it is easier in such a flat box to transport it to the location where it will be assembled. The way this invention accomplishes these results is as follows: The parts of the sofa can be broken down into three boxes. Chaise sections can be assembled by placing the seat back flat on the ground and placing the seat frame/arm upright on top of the seat back. A metal threaded rod is used to connect the seat frame and the seat back. A metal nut is used to secure the seat frame to the back using a wrench that comes provided in the package of the kit. The legs are then twisted onto the bottom of the seat frame. The Chaise can be assembled in a left handed or right handed configuration. There is also a love seat portion and an ottoman portion. The love seat portion can also be assembled in a left handed or right handed configuration. Turning now to FIG. 1, the parts found in the first box are shown disassembled. The first box contains five metal threaded rods (1), five nuts (2), five lock washers (3), five washers (4), a wrench (5), four feet 15, a first portion base (7), a first portion main back (8), and a first portion secondary back (9). Turning now to FIG. 2, three of the metal threaded rods are being used to attach the first portion main back (8) to the first portion base (7) by connecting to each of the metal threaded rods on the far side of the first portion base (7) in the following order: a washer (4), a lock washer (3), and a nut (2) using the wrench (5). Note the interior construction of the first portion base (7) in the cutaway. It is essentially a box formed of two rectangles each having long sides (10) and short sides (11). The two rectangles are held in a parallel configuration to form a box by the use of perpendicular spacers (12). A matrix of resilient bands (13) is placed parallel to one of the rectangles and it attaches to the perimeter of the rectangle. Angle braces (14) are placed in the corners of the rectangles for stability. The Chaise base, chaise main back and chaise secondary back, as well as the love seat base, love seat main back, love seat secondary back, and the ottoman base can all be constructed in this fashion. Turning now to FIG. 3, two of the metal threaded rods are being used to attach the first portion secondary back (9) to the first portion base (7) by connecting to each of the metal threaded rods (1) on the far side of the first portion base (7) in the following order: a washer (4), a lock washer (3), and a nut (2) using the wrench (5). Note: the first portion secondary back (9) is placed at the right elbow of a hypothetical person sitting on the base when it is placed on the floor. Turning now to FIG. 4, the feet (15) are screwed into the four bottom corners of the first portion base (7). FIG. 5 shows the first portion after assembly. Note that a cover (16) on the first portion base (7) envelopes the matrix of resilient bands (13) so they are not seen in this assembled view. Note that the chaise base, chaise main back and chaise secondary back, as well as the love seat base, love seat main back, love seat secondary back, and the ottoman base can all be constructed with such covers. FIG. 6 shows the assembled first portion after cushions (17) are added. The wrench (5) may be omitted from the first portion box if it is contained in the second portion box or the third portion box. Turning now to FIG. 7, three of the metal threaded rods (1) are being used to attach the first portion main back (8) to the first portion base (7) by connecting to each of the metal threaded rods (1) on the far side of the first portion base (7) in the following order: a washer (4), a lock washer (3), and a nut (2) using the wrench (5). Turning now to FIG. 8, two of the metal threaded rods (1) are being used to attach the first portion secondary back (9) to the first portion base (7) by connecting to each of the metal threaded rods (1) on the far side of the first portion base (7) in the following order: a washer (4), a lock washer (3), and a nut (2) using the wrench (5). Note: the first portion secondary back (9) is placed at the left elbow of a hypothetical person sitting on the base when it is placed on the floor. Turning now to FIG. 9, the feet (15) are screwed into the four bottom corners of the first portion base (7). FIG. 9 shows the first portion after assembly and FIG. 10 shows the assembled first portion after cushions are added. The wrench (5) may be omitted from the first portion box if it is contained in the second portion box or the third portion box. Turning now to FIG. 11, the parts found in the second box are shown disassembled. The second box contains four metal threaded rods (1), four nuts (2), four lock washers (3), four washers (4), a wrench (5), four feet (15), a second portion base (18), a second portion main back (19), and a second portion secondary back (20). Turning now to FIG. 12, two of the metal threaded rods (1) are being used to attach the second portion main back (19) to the second portion base (18) by connecting to each of the metal threaded rods (1) on the far side of the second portion base (18) in the following order: a washer (4), a lock washer (3), and a nut (2) using the wrench (5). Note that if the base is turned down to the floor the second portion main back (19) is installed in this example at the right elbow of a hypothetical person sitting on the base. Turning now to FIG. 13, three of the metal threaded rods (1) are being used to attach the second portion secondary back (20) to the second portion base (18) by connecting to each of the metal threaded rods on the far side of the second portion base (18) in the following order: a washer (4), a lock washer (3), and a nut (2) using the wrench (5). Turning now to FIG. 14, feet (15) are being screwed into the four bottom corners of the second portion base (18). FIG. 15 shows the second portion assembled and FIG. 16 shows the second portion after cushions (17) have been added. The wrench (5) may be omitted from the second portion box if it is contained in the first portion box or the third portion box. Turning now to FIG. 17, two of the metal threaded rods (1) are being used to attach the second portion main back (19) to the second portion base (18) by connecting to each of the metal threaded rods (1) on the far side of the second portion base (18) in the following order: a washer (4), a lock washer (3), and a nut (2) using the wrench (5). Note that if the base is turned down to the floor the second portion main back (19) is installed in this example at the left elbow of a hypothetical person sitting on the base. Turning now to FIG. 18, three of the metal threaded rods (1) are being used to attach the second portion secondary back (20) to the second portion base (18) by connecting to each of the metal threaded rods on the far side of the second portion base (18) in the following order: a washer (4), a lock washer (3), and a nut (2) using the wrench (5). Turning now to FIG. 19, feet (15) are being screwed into the four bottom corners of the second portion base (D). FIG. 20 shows the second portion assembled and FIG. 21 shows the second portion after cushions (17) have been added. The wrench (5) may be omitted from the second portion box if it is contained in the first portion box or the third portion box. Turning now to FIG. 22, the third portion is shown in a fully exploded diagram to have a third portion base (21), and four feet (15). FIG. 23 is a cutaway view showing the frame of wood or other suitable substance that the fabric or other upholstery is mounted on. Turning now to FIG. 24, the feet (15) are being screwed onto the four bottom corners of the third portion base (21). FIG. 25 shows the third portion assembled and FIG. 26 shows the third portion after a cushion has been added. The third portion is of course shipped, stored, and sold in the third box. The parts of this sofa kit can thus be fit into three boxes for easy shipping, storage, and sale and yet they can easily be assembled at home by the end user. The attachment means shown on the feet (15) in the drawing sheets comprises a threaded metal cylindrical extension which can be screwed into a corresponding hole on a furniture base, but several other attachment means for feet are well known in the furniture arts. Applicant does not intend to be limited to this one attachment means.

I claim:

1. A sofa kit comprising:

An oblong box frame having a first rectangle and a second rectangle; a plurality of first spacers; a first load bearing matrix; first corner braces; and a first covering;

said first rectangle having two first rectangle long sides and two first rectangle short sides, both of said first rectangle long sides having the same respective length, and both of said first rectangle short sides having the same respective length;

each of said first rectangle long sides having a first end, each said first end having one of said first rectangle short sides attached to said first end;

each of said first rectangle long sides having a second end, each said second end having one of said first rectangle short sides attached to said second end;

said first load bearing matrix being so disposed that it is attached to said first rectangle long sides and said first rectangle short sides;

said second rectangle having two second rectangle long sides and two second rectangle short sides, both of said second rectangle long sides having the same respective length, and both of said second rectangle short sides having the same respective length;

each of said second rectangle long sides having two ends designated herein as a third end and a fourth end, each said third end having one of said second rectangle short sides attached to said third end;

each said fourth end having one of said second rectangle short sides attached to said fourth end;

said second rectangle long sides having the same length as said first rectangle long sides;

said second rectangle short sides having the same length as said first rectangle short sides;

said first rectangle is parallel to said second rectangle and said first rectangle is connected to said second rectangle by said plurality of first spacers;

said plurality of first spacers is perpendicular to said first rectangle and perpendicular to said second rectangle;

said first corner braces reinforce said first rectangle and said second rectangle; and said first covering enveloping said oblong box frame;

an elongate box frame having a third rectangle and a fourth rectangle; a plurality of second spacers; a plurality of second corner braces; and a second covering;

said third rectangle having two third rectangle long sides and two third rectangle short sides, both of said third rectangle long sides having the same respective length, and both of said third rectangle short sides having the same respective length;

each of said third rectangle long sides having two ends designated herein as a fifth end and a sixth end, each said fifth end having one of said third rectangle short sides attached to said fifth end;

each said sixth end having one of said third rectangle short sides attached to said sixth end;

said fourth rectangle having two fourth rectangle long sides and two fourth rectangle short sides, both of said fourth rectangle long sides having the same respective length, and both of said fourth rectangle short sides having the same respective length;

each of said fourth rectangle long sides having two ends herein designated as a seventh end and an eighth end, each said seventh end having one of said fourth rectangle short sides attached to said seventh end;

each said eighth end having one of said fourth rectangle short sides attached to said eighth end;

said fourth rectangle long sides having the same length as said third rectangle long sides;

said fourth rectangle short sides having the same length as said third rectangle short sides;

said third rectangle is parallel to said fourth rectangle and said third rectangle is connected to said fourth rectangle by said plurality of second spacers;

said plurality of second spacers is perpendicular to said third rectangle and perpendicular to said fourth rectangle;

said second corner braces reinforcing said third rectangle and said fourth rectangle; and said second covering enveloping said elongate box frame;

a back rest frame having a fifth rectangle and a sixth rectangle; a plurality of third spacers; a second load bearing matrix; third corner braces; and a third covering;

said fifth rectangle having two fifth rectangle long sides and two fifth rectangle short sides, both of said fifth rectangle long sides having the same respective length, and both of said fifth rectangle short sides having the same respective length;

each of said fifth rectangle long sides having two ends herein designated as a ninth end and a tenth end, each said ninth end having one of said fifth rectangle short sides attached to said ninth end;

each said tenth end having one of said fifth rectangle short sides attached to said tenth end;

said second load bearing matrix being so disposed that it is attached to said fifth rectangle long sides and said fifth rectangle short sides;

said sixth rectangle having two sixth rectangle long sides and two sixth rectangle short sides, both of said sixth rectangle long sides having the same respective length, and both of said sixth rectangle short sides having the same respective length;

each of said sixth rectangle long sides having two ends herein designated as an eleventh end and a twelfth end, each said eleventh end having one of said sixth rectangle short sides attached to said eleventh end;

each said twelfth end having one of said sixth rectangle short sides attached to said twelfth end;

said sixth rectangle long sides having the same length as said fifth rectangle short sides;

said fifth rectangle is parallel to said sixth rectangle and said fifth rectangle is connected to said sixth rectangle by said plurality of third spacers;

said plurality of third spacers is perpendicular to said fifth rectangle and perpendicular to said sixth rectangle;

said third corner braces reinforce said fifth rectangle and said sixth rectangle; and said third covering enveloping said back rest frame;

connection means; and a plurality of feet.

2. The sofa kit of claim 1 further comprising a plurality of cushions.

* * * * *